United States Patent [19]

Côté et al.

[11] Patent Number: 4,518,129

[45] Date of Patent: May 21, 1985

[54] COILERS

[75] Inventors: Gérard G. M. Côté, La Prairie; Bretislav P. Zuber, Montreal, both of Canada

[73] Assignee: Northern Telecom Limited, Montreal, Canada

[21] Appl. No.: 628,625

[22] Filed: Jul. 6, 1984

[51] Int. Cl.[3] ..... B65H 54/00

[52] U.S. Cl. ..... 242/78; 242/68.3; 242/129.7

[58] Field of Search ..... 242/78, 68.3, 115, 129, 242/129.5, 129.7, 129.71, 129.72

[56] References Cited

U.S. PATENT DOCUMENTS 4,087,057 5/1978 Sato ..... 242/68.3

4,366,932 1/1983 Focke ..... 242/68.3

4,423,609 1/1984 Itoh ..... 242/68.3 X

*Primary Examiner*—John M. Jillions

*Attorney, Agent, or Firm*—R. J. Austin

[57] ABSTRACT

A coiler for wire or other filamentary material lengths having a coil side support member provided with an axial extension and a release member extending radially of the release member. A spring means urges the release member into a locking position away from the support member, at which position link devices engage stop abutments on a support shaft. Movement of the release member away from the locking position and against spring action releases the link devices from the abutments and allows for removal of the support member from the coiler.

5 Claims, 3 Drawing Figures

COILERS

This invention relates to coilers.

Coilers are known for forming coils of different wire products such as steel wire, copper wire or wires formed from stranded filamentary materials. Coilers may also be used for coiling cables formed from insulated copper conductors or for coiling flexible tubes or fibers.

In certain constructions of coilers, each coiler has a core provided with a peripheral surface for supporting a coil as it is being formed, and two side support members in the form of flanges which extend radially outwards at each side of the core for supporting the sides of the coil. To allow for removal of a formed coil, one of the support members is detachably mounted onto the core or is collapsible to allow the coil to be moved around it during its removal from the coiler. In the case of the detachable support member, it is held in place by the passage of a retaining pin through a groove in a shaft which extends axially from the core. While this pin and groove arrangement is effective in providing a retaining mechanism, it has been found in practice that problems arise with use of the coiler during the passage of time. The removal and insertion of the pin at the commencement and end of each coiling operation and the axial pressure upon the pin during coiling, produces a wear between the pin and the groove which results in a progressively increasing looseness of the flange upon the shaft. Because of the looseness and wear upon the parts, such a coiler may be unsafe in use and cannot be used by operating personnel with confidence. In addition to this, looseness of the support member results in gaps developing between the support member and the core into which the wire may become wedged during coiling, thus resulting in wire breakage or damage to the coil during its formation. On the other hand, support members which are collapsible are formed from movable segments which are pivoted. Wear takes place at the pivotal positions, thus allowing for movement of the segments during coil formation. Thus, these segmented support members are also unsafe and movement of the segments causes gaps to develop between the segments and between the segments and the core. Wire may be trapped within these gaps so as to lead to wire breakage and coil damage in a manner similar to that discussed above.

The present invention provides a coiler having a detachable support member and in the use of which looseness of the support member does not result.

Accordingly, the present invention provides a coiler comprising a core with a peripheral surface to support a coil as it is being wound, and two side support members extending radially outwards, one at each side of the core member, one of the support members forming part of a support member and detachment means assembly having an axial passage which receives a shaft extending axially of the core, the assembly comprising an axial extension of the support member, a release member and spring means, the release member extending radially outwards from and connected to the extension by a plurality of link devices spaced apart around the passage, the link devices allowing for axial movement of the release member along the extension and away from the associated support member into a locking position in which each link device is pivoted to engage an abutment on the shaft so as to hold the assembly upon the shaft, axial movement of the release member out of its locking position serving to release the link devices from the abutment to allow for detachment of the assembly, and the spring means disposed to urge the release member into the locking position and thus urge the support member firmly into position against the core.

In the above coiler according to the invention, because the release member is moved away from the support member, the link devices are pivotally moved inwards to engage their respective abutments and then the spring means which is unable to force the release member any further away from the support member, operates in the opposite direction to force the support member against the core. Hence should any wear develop, say for instance between the link devices and the abutment, then this wear is taken up by the spring means urging the support member and release member further apart sufficiently to hold the link devices firmly against the abutment and the support member firmly against the core. Hence the firmness of the positioning of the support member against the core relies completely upon the spring action and the wear in the parts does not produce corresponding looseness of the support member.

One embodiment of the invention will now be described, by way of example, with reference to the accompanying drawings in which.

Figure 1:
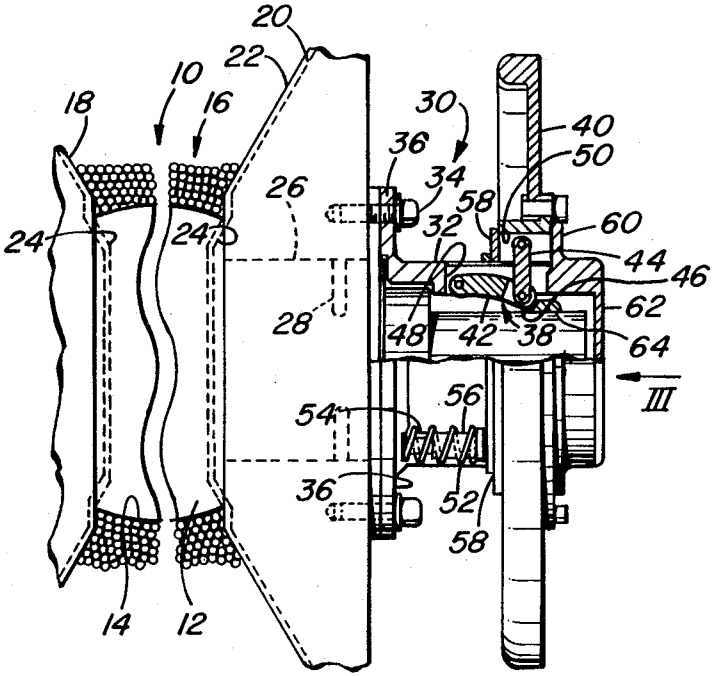
FIG. 1 is a side elevational view of part of a coiler and showing a detachment means in cross-section and holding a support member of the coiler in fixed position.

As shown in FIG. 1, a coiler 10 comprises a core 12 having a collapsible surface 14 for supporting a coil 16 as it is being wound from wire or insulated conductor or even a small diameter cable having, for instance, two or four insulated conductors contained within a jacket.

Two coil side support members 18 and 20 extend radially outwards, one at each side of the core member for supporting the sides of the coil as it is being formed. Flange 22 of each of the support members is flared outwardly, as shown by FIGS. 1 and 2, and an inward tapered section 24 of each flange is seated within a corresponding recess in the core to locate the support member in position.

The support member 18 is fixed to the core while the support member 20 is detachably mounted thereon for the purpose of enabling a coil 16 to be removed from the core after winding is completed. The support member 20 is mounted around a shaft 26 which extends axially from the core. The support member 20 and shaft 26 are of conventional construction and the shaft is formed with a radially extending groove 28. This groove forms no part of the present invention but exists in the shaft for the purpose of locating a locking peg through it according to conventional assembly procedure, for holding the support member 20 in position. A problem with this groove and peg arrangement is that wear easily takes place, thus allowing the support member to become loose upon the coiler. This looseness is not only dangerous to operating personnel but also makes it extremely difficult to form a wire coil correctly.

The present invention avoids the problem of the locking peg and groove arrangement by using a detachment means 30 which is secured to the support member 20 to form an assembly which is mounted and detached from the shaft 26 as a unit. The detachment means comprises an axial extension 32 of the support member which is secured to the support member by screws 34 passing through a flange 36 of the extension. The detachment means also comprises a plurality, namely four, link devices 38 which connect the extension 32 with a release ring 40 which is movable axially along the extension so as to pivot the link devices as will be described.

Figure 2:
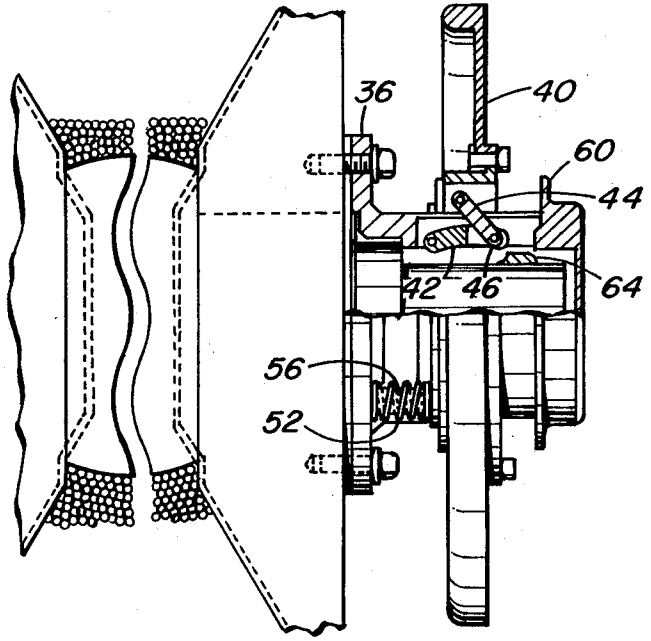
FIG. 2 is a view similar to FIG. 1 showing the detachment means after actuation and prior to removal of the support member.

As shown by FIGS. 1 and 2 particularly, each link device 38 comprises two links, a first of the links 42 pivotally connected to the extension and the second link 44 pivotally connected to the release member 40 so as to move axially with it. The two links are connected together at their ends 46, as shown by FIGS. 1 and 2. As shown by the Figures, each link device 38 is housed partly within an axially extending slot 48 in the extension and the link 44 extends radially from the slot 48 into a recess 50 in the release member 40.

A spring means is used to urge the release member in a direction away from the support member 20 so as to position the release member normally in a locking position in which the support member and detachment means assembly are held securely upon the shaft 26 and against the core 12. The spring means comprises a plurality of compression springs 52 which are disposed between the support and release members in spaced apart positions circumferentially around the extension 32. More particularly, each spring 52 surrounds two telescopically collapsible tubes 54 and 56 and extends so as to apply axial pressure between the flange 36 and a ring abutment 58 which is secured to the release member 40. As may be seen, this axial pressure forces the release member away from the support member 20 until the release member engages with a stop 60 (FIGS. 1 and 2) which forms part of an end cap 62 of the extension 32 so as to enclose the free end of the shaft 26.

Figure 3:
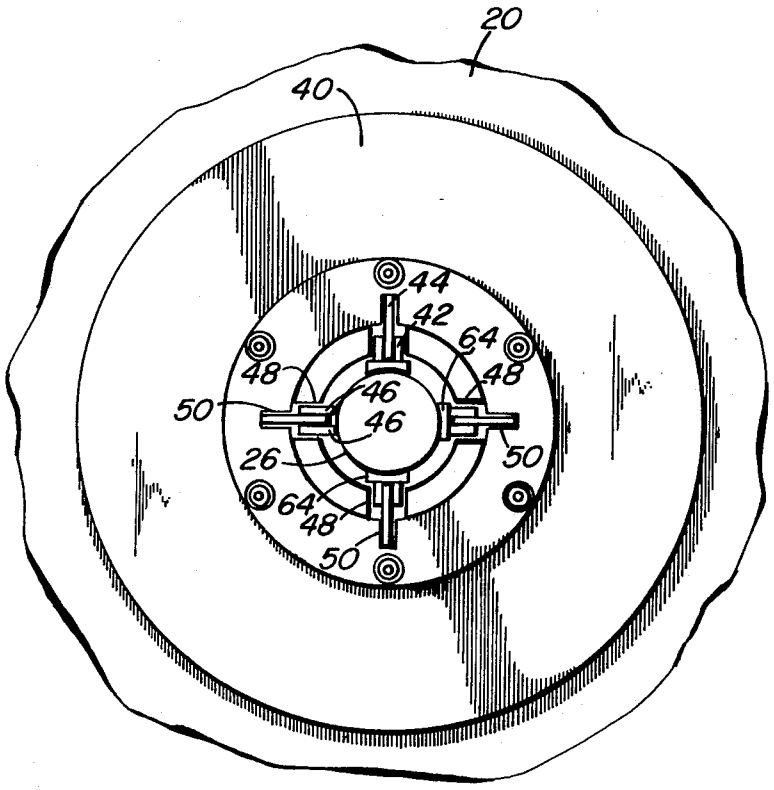
FIG. 3 is an end view of the detachment means and coiler in the direction of arrow 3 in FIG. 1 with an end of the detachment means removed for clarity.

As may be seen from FIG. 1, with the release member 40 forced into a position engaging the stop 60, the two links 42 and 44 are relatively pivoted so that their connecting ends 46 are moved to a radially inner position projecting from the slot 48. In this position of the links 42 and 44 of each link device, the ends 46 engage against an abutment 64 which is secured to the shaft 26. In FIG. 3, three of the abutments 64 are shown while the left hand side abutment 64 is omitted to show more clearly the structure of the links 42 and 44. If the release member 40 is moved towards the support member 20, however, it causes the pivotal position of the link 44 with the support member in each device to move axially across the extension 32 so that the ends 46 of the links move radially outwards to lie within the recess 48 whereby they become disengaged with the abutments 64. This is the position shown in FIG. 2.

In use of the coiler and the support member and detachment means assembly, with this assembly lying detached from the shaft 26, the release member 40 is held against the stop 60 by the compression springs 52. As the assembly is mounted upon the shaft 26, the support member 20 is urged axially towards the core 12 and as it approaches the core and becomes located in its use position, axial pressure upon the release member 40 by the operator in the direction of mounting of the assembly upon the shaft, causes the release member to move towards the support member against the action of the springs 52. As may be seen, this is an automatic movement of the operator during assembly because it is merely a continuation of movement in the direction of the core. This movement of the release member pivots the link devices into the position shown in FIG. 2 to enable them to move axially around the abutments 64 without any interference. Upon the release member reaching its axially inner position as shown in FIG. 2 and with the support member in its use position as shown, release of the release member causes the springs 52 to force it back to its normal locking position against the stop 60 as shown in FIG. 1. Simultaneously with this, the ends 46 of the links move radially inwards to engage the abutment 64 whereby movement of the support member and detachment means assembly away from the core is prevented. The coil 16 is then wound upon the core with the side members 18 and 20 acting to retain the coil in position during the winding process. Upon completion of the coil, the release member 40 is then forced towards the support member 20 to return it to the position shown in FIG. 2 whereby the ends 46 of the links move radially outwards and out of engagement with the abutments 64. In this position of the release member, the operator may hold the support member and release member in their closer positions while he withdraws the assembly from the shaft 26 with the link devices radially clear from the abutments 64. The coil may then be removed from the core.

As may be seen from the above description, the use of a plurality of link devices, as shown, evenly distributes the loading of the detachment means assembly around the shaft 26 so that little or no out of balance loading takes place which could cause wear or distortion of the parts during rotation of the coiler as the coil is being formed. Eccentricity in the loading around the shaft is thereby minimized as far as possible. Apart from this, because of the use of the spring means, then the support member 20 is always urged securely into its seating position against the core during use, notwithstanding that wear may take place in parts of the support member and detachment means assembly. For instance, while the links may be made from high tensile steel so as to reduce the possibility of wear, wear may in fact take place over a long period of use. However, even if such wear does take place, then the links would not become loose in their engagement with the abutments 64. In contrast, the springs 52 would merely force the release member 40 further away from the support member 20 to compensate for this wear so that the ends 46 of the links retain engagement with the abutment 64 in the use position. It follows from this, that any wear of the links or the abutment 64 merely results in the release member assuming a position further spaced from the support member to hold it firmly in position. It should be borne in mind that with the links firmly seated against the abutment 64, then the release member is unable to move any further away from the support member 20, i.e. towards the right in FIG. 1. As a result, when the springs 52 have caused the link ends 46 to assume their full seating position with the abutment 64, then any further movement apart of the support member and the release member may only take place by the support member moving more towards the left in FIG. 1, i.e. into a firm seating position with the core. It follows from this, that any wear in the parts of the assembly does not result in looseness of the support member as with conventional constructions, but the use of the spring means does in fact ensure that complete and solid seating of the core and support member is continuously maintained during use.

What is claimed is:

1. A coiler comprising a core with a peripheral surface to support a coil as it is being wound, and two coil side support members extending radially outwards, one at each side of the core, one of the support members forming part of a support member and detachment means assembly having an axial passage which receives a shaft extending axially of the core, the assembly comprising an axial extension of the support member, a release member and spring means, the release member extending radially outwards from and connected to the extension by a plurality of link devices spaced apart around the passage, the link devices allowing for axial movement of the release member along the extension and away from the associated support member into a locking position in which each link device is pivoted to engage an abutment on the shaft so as to hold the assembly upon the shaft, axial movement of the release member out of the locking position serving to release the link devices from the abutment to allow detachment of the assembly, the spring means disposed to urge the release member into the locking position and thus urge the support member firmly into position against the core.

2. A coiler according to claim 1, wherein each link device comprises two links, a first of the links pivotally connected to the extension and the second link pivotally connected to the release member so as to move axially with it, and the links operably connected together so as to occupy a radially inner position of the extension and engage the abutment with the release member in the locking position, movement of the release member towards the support member serving to move the links to a radially outer position in which they lie radially outwards of the abutment and are disengaged from it.

3. A coiler according to claim 1, wherein the spring means comprises at least one compression spring disposed between the support and release members.

4. A coiler according to claim 3, wherein the spring means comprises a plurality of compression springs disposed between the support and release members, the springs in spaced apart positions circumferentially around the extension.

5. A coiler according to claim 2, wherein each link device is housed partly within an axially extending slot in the extension so a to project radially inwardly from the slot in the locking position and partly within a recess in the release member which is aligned with the slot, the second link pivotally connected to the release member within the recess.

* * * * *